United States Patent [19]

Thalenfeld

[11] 4,405,051

[45] * Sep. 20, 1983

[54] MERCHANDISE HOOK

[75] Inventor: David R. Thalenfeld, Beechurst, N.Y.

[73] Assignee: Trion Industries, Inc., Wilkes-Barre, Pa.

[ * ] Notice: The portion of the term of this patent subsequent to Feb. 16, 1999, has been disclaimed.

[21] Appl. No.: 339,885

[22] Filed: Jan. 18, 1982

Related U.S. Application Data

[60] Division of Ser. No. 151,357, May 19, 1980, Pat. No. 4,351,440, which is a continuation-in-part of Ser. No. 918,483, Jun. 23, 1978, abandoned.

[51] Int. Cl.[3] ..... A47F 5/00

[52] U.S. Cl. ..... 211/57.1; 40/19.5; 248/220.4; D8/373

[58] Field of Search ..... 211/59.1, 57.1, 54.1; 248/220.3, 220.4, 221.1; D8/373, 363; 40/19.5

[56] References Cited

U.S. PATENT DOCUMENTS

| | | | |
|---|---|---|---|
| D. 249,460 | 9/1978 | Bleed | D8/373 |
| 3,245,547 | 4/1966 | Felkay | 248/220.4 X |
| 3,374,898 | 3/1968 | Karmin | 248/221.1 |
| 3,442,396 | 5/1969 | Cass | 211/182 X |
| 3,645,485 | 2/1972 | Gold | 211/59.1 X |
| 3,976,201 | 8/1976 | Hodgson et al. | 248/220.4 |
| 4,351,440 | 9/1982 | Thalenfeld | 211/57.1 |

*Primary Examiner*—Ramon S. Britts

*Assistant Examiner*—Robert W. Gibson, Jr.

*Attorney, Agent, or Firm*—Mandeville and Schweitzer

[57] ABSTRACT

The disclosure relates to a display hook featuring a novel display system highly compatible with computerized inventory management under the Universal Product Code System. The display system provides labeling or product information in an easily accessible location, while allowing the labeling to be readily replaced and securely mounted at the same time. The display hook may also be used to display carded and/or bagged merchandise, with highly desirable safety features. The display hook is formed of a single, continuous wire-like element in an outwardly extending arm, carrying at its outer extremity a display element. This display element can hold labels of any desired size economically. A preferred embodiment of the display element is a mounting means, preferably a mounting plate, carried by the arm, at its forward extremity, upon which an attachment is mounted to form a plate-like label holder. The label holder serves importantly to provide for the display, at the forwardmost extremity of the unit, for easy scanning by computer input equipment, of a Universal Product Code label specific to the merchandise on display at the hanger. The mounting plate may be ribbed to hold the label holder tightly but slidably, and the label holder in turn may be ribbed to hold a flexible, removable label securely. The label holder can also act as a guard means when the wire-like element is used in association with a lower outwardly extending merchandise supporting arm.

15 Claims, 5 Drawing Figures

MERCHANDISE HOOK

RELATED APPLICATIONS

This application is a divisional of my co-pending application Ser. No. 151,357, filed May 19, 1980, now U.S. Pat. No. 4,351,440, which is in turn a continuation-in-part of my co-pending application Ser. No. 918,483, filed June 23, 1978, now abandoned.

BACKGROUND AND SUMMARY OF THE INVENTION

A great deal of merchandise is displayed for sale by means of display hooks mounted on apertured panel board. The arrangement facilitates attractive, easily changeable point-of-purchase display arrangements. On each of a plurality of merchandise display hooks, a plurality of similar items of carded or bagged merchandise are suspended, which may be removed one at a time by customers. A particularly advantageous form of such display hooks is represented by, for example, the Thalenfeld U.S. Pat. No. 3,289,993, owned by Trion Industries, Inc. of Garden City, N.Y.

One important function of these display hooks is to present labelling information in front of the merchandise where it may be easily read. It is necessary that the labels be readily replaceable to reflect changing goods or prices, but the support for the label must be secure and sturdy enough to withstand mishandling or mischief.

A second characteristic inherent in most forms of panel board display hook arrangements is the outward projection of a wire-like merchandise supporting element of substantial length. This structural configuration, if improperly arranged by store personnel, has a potential to cause injury, in the case of a customer who accidentally falls against the projecting wire. With increasing emphasis being placed upon product safety considerations, significant efforts have been made to improve upon the inherent safety of panel board merchandise display arrangements. One advantageous form of merchandise hook for this purpose is described and claimed in the Karmin U.S. Pat. No. 3,374,898, also owned by Trion Industries, Inc. In part, the device of the present invention represents an improvement on the general type of hook shown in the Karmin patent.

In accordance with one objective of the invention, an improved panel board merchandise display member is provided, in which a wire-like, projecting arm has novel means for the support and presentation of pricing and/or inventory information. At the outer end of the display member, there is formed or otherwise provided an information display means, in the form of mounting means, preferably a mounting plate, upon which a plate-like attachment is mounted.

In accordance with one objective of the invention, the plate-like attachment may be of extruded, advantageously somewhat rigid material, which is adapted for attachment to the merchandise display hook in a semi-permanent manner to discourage unauthorized removal and/or exchange of product information coding.

The mounting means is preferably in the form of a metal mounting plate with upper and lower mounting flanges which the plate-like attachment may tightly but slidingly engage.

In accordance with a preferred aspect of the invention, a novel and advantageous plate-like attachment is provided for mounting on the mounting plate located at the extreme end area of the display arm. Importantly, the plate-like device forms a label holder for a Universal Product Code information label, carrying product pricing and inventory information. The nature and location of the label holder is such as to place the label in a highly prominent position, out in front of the suspended merchandise, not only that of the particular display device in question, but also that of the neighboring devices, both above and to the side. The label-holding plate provides prominently displayed price and product information for the convenience of the customer. In this respect, although the Universal Product Code system is coming into increasingly widespread use, it has been, up to this time, difficult and impracticable to utilize the Universal Product Code system for inventory purposes with respect to rack-supported merchandise, as is contemplated by the present invention.

When the mounting means comprises mounting flanges, the label holder may have corresponding flanges which tightly but slidingly engage the mounting flanges. The mounting flanges may be ribbed to provide additional holding power.

The label-holding device of the present invention not only provides a convenient and highly efficient facility for utilization of the Universal Product Code, but in addition provides for improved safety in the wire hook display or rack merchandise.

The extruded form of label holder provides for a high degree of flexibility to meet customer needs and desires, while enabling the product to be marketed at low cost. In particular, the length and height of the label may be varied independently of each other and of the dimensions of the mounting plate. Thus, a standarized mounting plate may be used while the label holder may change size and shape to meet the specialized needs of each particular consumer at little expense. In view of rapidly changing advertising formats, this presents a distinct advantage over other, more limited, label displays.

For a more complete understanding of the above and other features and advantages of the invention, reference should be made to the following detailed description of a preferred embodiment and to the accompanying drawings.

DESCRIPTION OF A PREFERRED EMBODIMENT

Figures 1, 2, 3, 4, 5:
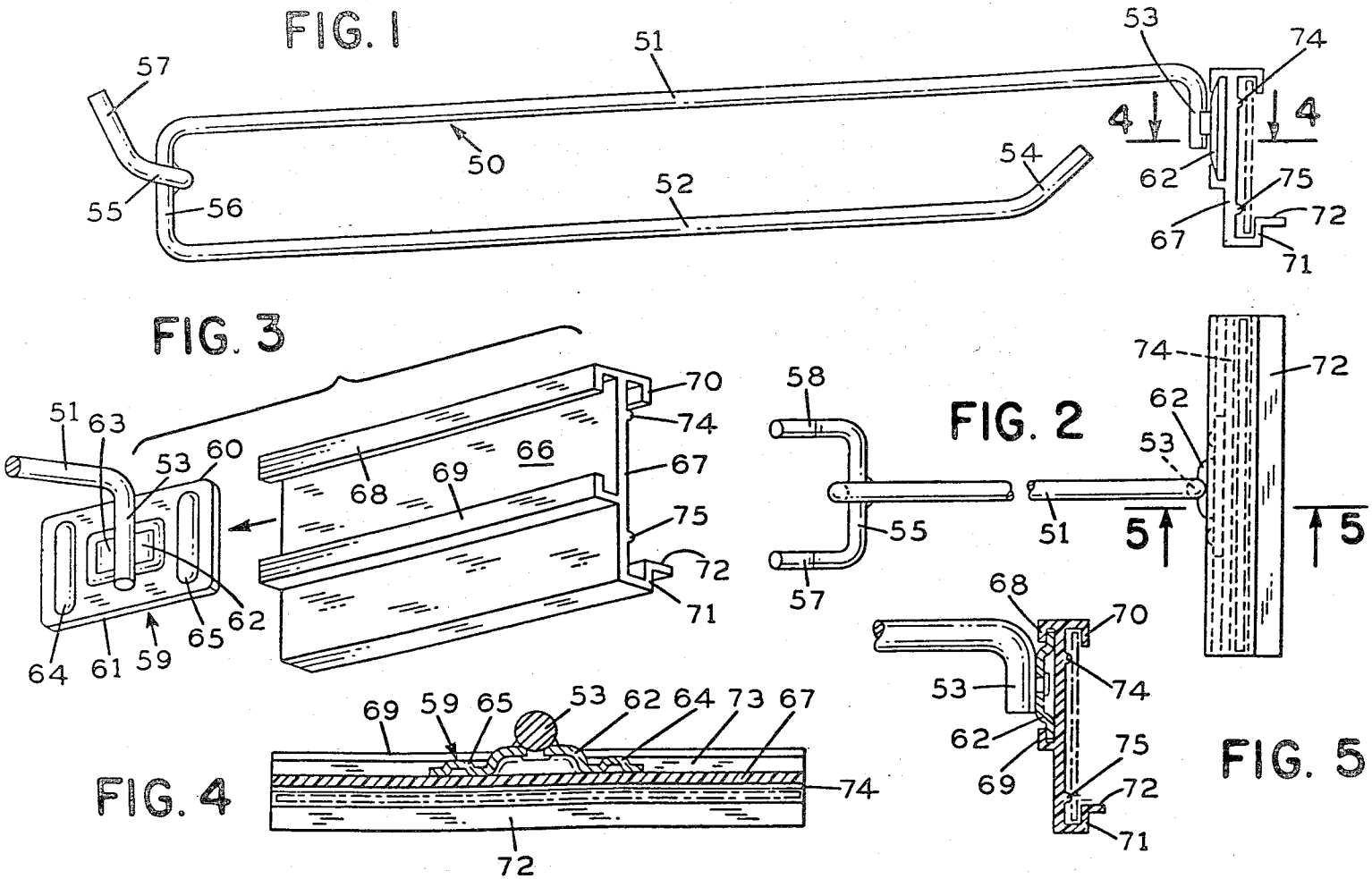
FIG. 1 is a side elevational view of an advantageous form of display hook incorporating the product code label holder and other novel and useful features of the invention.
FIG. 2 is a top plan view of the device of FIG. 1, with parts broken away.
FIG. 3 is a fragmentary perspective view of the device of FIG. 1, illustrating the manner in which the label-holding plate is mounted to the safety arm of the merchandise hook.
FIG. 4 is a cross sectional view as taken generally on line 4—4 of FIG. 1.
FIG. 5 is a cross sectional view as taken generally on line FIG. 5—5 of FIG. 2.

In a preferred embodiment of the invention shown in FIGS. 1–5, a wire-like merchandise hook 50 of U-shaped configuration is formed with an upper display arm 51 and a lower, product supporting arm 52. To advantage, the display arm 51 has a downturned portion 53 at its outer extremity, which is located forward of and typically above the upturned outer end extremity 54 of the product supporting arm.

In the embodiment under consideration, a generally U-shaped mounting element 55 is welded or otherwise permanently secured to the base portion 56 of the U-shaped element and is provided with spaced mounting lugs 57, 58 for reception in an apertured display panel. It will be understood, of course, that any conventional or effective means for mounting the hook on the display system may be utilized if desired. The mounting arrangement of FIGS. 1–5 has the advantage of simplicity and low manufacturing cost.

In the illustrated embodiment of the invention, a mounting plate 59 is welded to the front of the downwardly extending portion 53 of the display arm. The mounting plate 59 is generally rectangular in configuration, having upper and lower edges 60, 61 which are desirably parallel and horizontal when the device is properly mounted. In general, the plate 59 is oriented in a plane approximately at right angles to the axis of the safety arm 51, so as to be more or less vertically oriented when the device is mounted in its normal display position.

In the illustrated arrangement, the mounting plate 59 is provided in its center area with a stamped depression area 62, which is offset slightly to the rear and forms an arcuate saddle 63, for more secure attachment of the plate to the wire portion 53. Adjacent each lateral edge, the mounting plate 59 is provided with vertically extending, rearwardly projecting stamped-in ribs 64, 65, the upper and lower ends of which extend near to but typically short of the upper and lower plate edges 60, 61.

Pursuant to one aspect of the invention, a label holder element 66 is provided, which is of a constant cross section, suitable for continuous production by extrusion techniques, followed by severing to any appropriate predetermined length. In a typical device according to FIGS. 1–5 hereof, the length of the label holder 66 approximately corresponds to the length of a standard size label utilized in the Universal Product Code labeling system, which in turn may be and usually is considerably longer than the mounting plate 59. By way of example only and not of limitation, the length of the mounting plate 59 may be on the order of 2.5 cm, while a typical length of the label holder 66 may be on the order of 6.3 cm.

As reflected in FIGS. 1, 3 and 5 in particular, the label holder 66 is extruded in a form to provide a main panel wall 67, upper and lower inturned rear flanges 68, 69, upper and lower inturned front flanges 70, 71 and a forwardly projecting horizontal guide flange 72 along the bottom edge. A merchandise display hook having such a novel guide flange comprises the subject matter of co-pending application Ser. No. 151,357 also owned by Trion Industries, Inc. The rear flanges 68, 69, which may be referred to as mounting flanges, extend toward each other sufficiently to overlap slightly the end extremities of the rearwardly displaced vertical ribs 64, 65 of the mounting plate. Desirably, the normal space 73 (see FIG. 4) between the main panel 67 and the mounting flanges 68, 69 is equal to and perhaps slightly greater than the thickness of the mounting plate 59 at its upper and lower extreme margins, but is narrower than the thickness of the plate in the region of the ends of the vertical ribs 64, 65. Accordingly, when the label holder 65 is applied to the mounting plate 59 by inserting the mounting plate 59 laterally into the slot formed by the mounting flanges 68, 69, the mounting plate is gripped tightly by the edge extremities of the mounting flanges 68, 69 overlapping and pressing tightly on the end extremities of the ribs 64, 65.

The described arrangement is simple, inexpensive, capable of accommodating typical manufacturing tolerances in the manufacture of the mounting plate 59 and the extruded label holder 66 and is effective in discouraging unauthorized removal of the label holders after assembly. At the same time, the friction is not so great as to make difficult the assembly of the label holder to the mounting plate.

At the front of the label holder 66, the front flanges 70, 71, which may be referred to as label mounting flanges, define a slot of suitable height to receive a standard size label. Longitudinal ribs 74, 75 are provided along the front face of the panel 67, projecting outward therefrom. Desirably, the forward projection of the ribs 74 is such, in relation to the spacing of the flanges 70, 71 from the panel 67, as to cause a slight forward bowing of a label 76 to increase its frictional engagement with the label holder. Of course, it is possible to utilize an adhesive label where that is desired, in which case the label holding flanges may be omitted.

In any of its forms, the merchandise display hook of the invention has substantial advantages. The label holding plate, mounted at the outer end of the safety arm, provides for greatly increased visibility of the outermost extremity of the device, so as to reduce the likelihood of customer contact and resulting possible injury. Of great significance, the label holder, mounted at the forwardmost extremity of the display device provides a highly advantageous arrangement for inventory control using Universal Product Code labeling procedures. By locating the label holder out at the forwardmost extremity of the display unit, product pricing and information is prominently displayed, readily visible, and easily accessible for the scanning procedures required in automated inventory control.

The label holder and mounting means of the invention are rugged and reliable, yet capable of manufacture at very low cost. The extruded construction of the label holder 66 accommodates such low cost production objectives particularly well. With a given extrusion, label holders may easily be cut to any desirable length. In addition, extrusion dies are very inexpensive, so that specific customer needs and desires can be easily met.

The extruded label holder 66 is designed for close, tight, slideable interfitting with the mounting plate 59. The design of the mounting plate with spaced vertical ribs, provides a simple, expedient yet highly effective arrangement for the semi-permanent mounting of the extruded plastic label holder 66 on to the metal mounting plate. The arrangement is well suited to the rather wide manufacturing tolerances inherent in the production techniques employed.

In the illustrated form of the invention, the label holder is positioned to extend primarily downward from the outer end of the safety arm, having minimum upward projection from the upper limits of the safety arm. This can be important in minimizing interference with the removal of merchandise from an adjacent, higher merchandise supporting arm.

It will be recognized that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A display member for a display structure to display labels or other information, said member having means for being mounted upon said display board, wherein
(a) said member comprises a wire-like element,
(b) said wire-like element including an outwardly projecting display arm,
(c) a mounting plate being rigidly and transversely secured to an outer end extremity of said display arm,
(d) a plate-like label holder comprising an extruded section having upper and lower rearwardly projecting mounting flanges adapted for tight slidable engagement with said mounting plate,
(e) said label holder being of any predetermined length, whereby the label holder may have a length independent of the length of the mounting plate.

2. A display member according to claim 1, further characterized by
(a) said mounting plate being of metal construction, having upper and lower edges and horizontally spaced rearwardly projecting vertical ribs extending to areas adjacent said upper and lower edges, and
(b) said upper and lower mounting flages having portions overlying and frictionally gripping the end areas of said vertical ribs.

3. A merchandise member according to claim 1, further characterized by
(a) said label holder including a label supporting panel extending generally from the region of said upper mounting flange to a level below said lower mounting flange.

4. A merchandise member according to claim 3, further characterized by
(a) said label holder being extruded from a material such as high impact styrene.

5. A merchandise member according to claim 3, further characterized by
(a) said mounting plate being a generally flat metal plate having generally horizontal upper and lower edges,
(b) said upper and lower mounting flanges being slidably received over and frictionally gripping said mounting plate in the region of said upper and lower edges.

6. A merchandise member according to claim 5, further characterized by
(a) said mounting plate having a limited number of forwardly or rearwardly displaced areas in the regions of said upper and lower edges,
(b) said displaced areas being engageable by and frictionally restraining said upper and lower mounting flanges.

7. A merchandise member according to claim 5, further characterized by
(a) said mounting plate being of substantially smaller length and height dimensions than said label holder.

8. A merchandise display member for a display structure, having means for being mounted upon said display board, said member comprising
(a) a continuous, generally U-shaped wire-like element having a lower, article-supporting arm and an upper safety arm,
(b) a mounting plate being rigidly secured to the outer end of said safety arm,
(c) a label holder comprising an extruded section having upper and lower rearwardly projecting mounting flanges adapted for tight slidable engagement with said mounting plate,
(d) said label holder being of any predetermined length, whereby the label may have a length independent of the length of the mounting plate,
(e) said article-supporting arm having its outer end extremity positioned behind said label holder whereby it is guarded and protected.

9. A display member for a display structure, having means for being mounted upon said display structure, comprising
(a) a wire-like outwardly extending element,
(b) generally horizontal first mounting flanges rigidly carried at the outer end of said wire-like element,
(c) a plate-like label holder adapted for mounting transversely upon said outer end of said wire-like element,
(d) said label holder comprising an extruded section having upper and lower rearwardly projecting second mounting flanges adapted for tight slideable engagement with said first mounting flanges,
(e) said label holder being of any predetermined length, whereby said label may have a length independent of the length of said first mounting flanges.

10. A display member according to claim 9, further comprising
(a) said first mounting flanges being of metal construction, having horizontally spaced forwardly or rearwardly projecting displaced areas extending from areas adjacent said upper and lower edges, and
(b) said upper and lower second mounting flanges having portions overlying and frictionally gripping said displaced areas.

11. A display member according to claim 9, further characterized by
(a) said label holder including a label supporting panel extending generally from the region of said upper second mounting flange to a level below said lower second mounting flange.

12. A display member according to claim 11, further characterized by
(a) said label holder being extruded from a material such as high impact styrene.

13. A display member according to claim 9, further characterized by
(a) said first mounting flanges being of substantially smaller length and height dimensions than said label holder.

14. A display member according to claim 9, further comprising
(a) a lower article supporting arm of the same material as said wire-like element extending outwardly from the inwardmost extremity of said wire-like element to form a continuous U-shaped, wire-like element,
(b) said article supporting arm having its outer end extremity positioned behind said label holder whereby it is guarded and protected,
(c) said label holder extending generally downard from said wire-like element and having a minimum upward projection from the upper limits of said wire-like element.

15. A display hook according to claim 9, wherein
(a) said first mounting flanges are upper and lower edges of a mounting plate,
(b) said mounting plate being secured to the end of said wire-like element.

* * * * *

UNITED STATES PATENT AND TRADEMARK OFFICE

CERTIFICATE OF CORRECTION

PATENT NO. : 4,405,051

DATED : September 20, 1983

INVENTOR(S) : David R. Thalenfeld

It is certified that error appears in the above-identified patent and that said Letters Patent is hereby corrected as shown below:

On the title page, under the heading "Notice:" should read

-- The portion of the term of this patent subsequent to Sept. 28, 1999, has been disclaimed. --

Signed and Sealed this

Seventeenth Day of February, 1987

*Attest:*

DONALD J. QUIGG

*Attesting Officer*

*Commissioner of Patents and Trademarks*